US008827073B2

(12) United States Patent
Herron et al.

(10) Patent No.: US 8,827,073 B2
(45) Date of Patent: Sep. 9, 2014

(54) GOLF BAGS HAVING A FLIP POCKET AND/OR A SYMMETRIC CLUB SEPARATOR

(75) Inventors: Heather L. Herron, Portland, OR (US); Jeffrey W. Wear, Lake Oswego, OR (US); Pierre A. Pactanac, Portland, OR (US)

(73) Assignee: Nike, Inc., Beaverton, OR (US)

( * ) Notice: Subject to any disclaimer, the term of this patent is extended or adjusted under 35 U.S.C. 154(b) by 355 days.

(21) Appl. No.: 13/168,448

(22) Filed: Jun. 24, 2011

(65) Prior Publication Data

US 2012/0325699 A1 Dec. 27, 2012

(51) Int. Cl.
*A63B 55/00* (2006.01)
*A63B 55/08* (2006.01)

(52) U.S. Cl.
CPC ..... *A63B 55/008* (2013.01); *A63B 55/00* (2013.01); *A63B 55/08* (2013.01); *A63B 2209/08* (2013.01)
USPC ..... 206/315.5; 206/315.3

(58) Field of Classification Search
CPC ..... A63B 55/00
USPC ..... 206/315.2, 315.3, 315.5, 315.4; 224/274, 918, 919; 248/96; 280/DIG. 6; 383/40, 38
See application file for complete search history.

(56) References Cited

U.S. PATENT DOCUMENTS 1,532,941 A * 4/1925 Pierce ..... 206/315.5
1,795,880 A * 3/1931 Mullins ..... 224/581
1,939,488 A * 12/1933 Dent et al. ..... 206/315.8
1,968,723 A 7/1934 Thorsen
2,009,072 A * 7/1935 Sampson ..... 206/315.4
2,144,791 A * 1/1939 Burton ..... 206/315.4
2,687,755 A * 8/1954 Smith ..... 383/40
2,698,040 A * 12/1954 Wilkens ..... 206/315.8
2,866,490 A * 12/1958 Thompson ..... 206/315.4

(Continued)

FOREIGN PATENT DOCUMENTS

DE 102009004140 7/2010
JP 2007190301 8/2007

OTHER PUBLICATIONS

Pictures and information relating to Callaway Golf Bags including a concealed strap tunnel behind a top pocket and Callaway's "Strap Bit Technology" for keeping bag secure and Twist Free on the cart (commercially available before the filed of this application and at least as early as Nov. 13, 2010).

(Continued)

*Primary Examiner* — Sue A Weaver
(74) *Attorney, Agent, or Firm* — Banner & Witcoff Ltd.

(57) ABSTRACT

Golf bags may include a main compartment for holding golf clubs and a flip pocket attached with the golf bag body but movable between an engaged position and a disengaged position. The bag may further include: (a) a releasable connector system for releasably holding the flip pocket at the engaged position; (b) an anti-slip element for preventing movement of the golf bag body with respect to a securing strap; and/or (c) a divider to help keep the golf clubs separated from one another when stored in the main compartment. Optionally, an outer perimeter of the divider may be symmetric about a first axis extending in a front-to-rear direction, symmetric about a second axis extending in a side-to-side direction, and/or symmetric about a third axis extending in a top-to-bottom direction (when the golf bag is oriented in an upright manner). Methods of making and using such golf bags also are described.

23 Claims, 14 Drawing Sheets

(56) References Cited

U.S. PATENT DOCUMENTS

| | | | | |
|---|---|---|---|---|
| 3,128,812 | A * | 4/1964 | Scheurer | 206/315.4 |
| 3,334,910 | A | 8/1967 | Wilson et al. | |
| 3,371,898 | A | 3/1968 | Murray, Jr. | |
| 3,955,609 | A * | 5/1976 | Siegel | 150/117 |
| 4,029,136 | A | 6/1977 | Jacoby | |
| 4,142,563 | A | 3/1979 | Ackerfeldt et al. | |
| 4,311,178 | A | 1/1982 | Kennedy | |
| 4,691,823 | A | 9/1987 | Pape | |
| 4,869,365 | A | 9/1989 | Perdue et al. | |
| 4,905,827 | A * | 3/1990 | Kim | 206/315.3 |
| 5,226,533 | A | 7/1993 | Antonious | |
| 5,341,928 | A | 8/1994 | Jones et al. | |
| 5,560,479 | A | 10/1996 | Leyba et al. | |
| 5,662,058 | A | 9/1997 | Wang | |
| 5,871,183 | A * | 2/1999 | Milluzzi | 248/96 |
| 6,149,000 | A | 11/2000 | Kim | |
| 6,161,692 | A | 12/2000 | Lizarraga | |
| 6,220,432 | B1 * | 4/2001 | Tan | 206/315.3 |
| 6,269,947 | B1 | 8/2001 | Chang | |
| 6,357,585 | B1 | 3/2002 | Shin | |
| 6,478,151 | B1 | 11/2002 | Schmidt et al. | |
| 6,520,327 | B1 | 2/2003 | Boardman et al. | |
| 6,634,496 | B2 | 10/2003 | Scoglio | |
| 6,637,590 | B1 * | 10/2003 | Matsuki | 206/315.5 |
| 6,766,905 | B1 | 7/2004 | Chang | |
| 6,935,496 | B2 | 8/2005 | Chang et al. | |
| 7,090,075 | B1 | 8/2006 | Rocha | |
| D530,922 | S | 10/2006 | Anderson | |
| D557,502 | S | 12/2007 | Quartarone et al. | |
| D577,916 | S | 10/2008 | Quartarone et al. | |
| D580,656 | S | 11/2008 | Quartarone et al. | |
| D613,064 | S | 4/2010 | Quartarone, III et al. | |
| 7,753,202 | B2 | 7/2010 | Anderson | |
| 2003/0094390 | A1 | 5/2003 | Thompson et al. | |
| 2003/0201197 | A1 * | 10/2003 | Lee | 206/315.5 |
| 2005/0061693 | A1 | 3/2005 | Chen | |
| 2005/0258206 | A1 * | 11/2005 | Tan | 224/274 |
| 2006/0011682 | A1 | 1/2006 | Christensen et al. | |
| 2006/0118440 | A1 | 6/2006 | Shiao | |
| 2007/0267454 | A1 | 11/2007 | Baiz | |
| 2008/0047639 | A1 * | 2/2008 | Fox | 150/160 |
| 2009/0107864 | A1 | 4/2009 | Tan | |
| 2009/0261600 | A1 * | 10/2009 | D'Ambrosio | 292/251.5 |
| 2012/0085666 | A1 * | 4/2012 | McGuire | 206/315.3 |

OTHER PUBLICATIONS

International Search Report and Written Opinion in related International Patent Application No. PCT/US2012/042900 dated Oct. 4, 2012.

Office Action in related U.S. Appl. No. 13/168,442 dated Aug. 7, 2013.

Final Office Action mailed Mar. 27, 2014 for U.S. Appl. No. 13/168,442.

* cited by examiner

GOLF BAGS HAVING A FLIP POCKET AND/OR A SYMMETRIC CLUB SEPARATOR

FIELD OF THE INVENTION

This invention relates generally to golf bags. Golf bags in accordance with at least some examples of this invention include structures for allowing better securing of the golf bag with transport devices and/or more convenient manufacturing.

BACKGROUND OF THE INVENTION

The sport of golf is very popular in the world today. Technological innovations have been regularly improving almost every aspect of the game, including the equipment used to tote the golf clubs both on and away from the golf course. Golf bags that were once made from heavy canvas and steel rods have been replaced by bags made from lighter, more durable composites, metals, plastics, and other materials.

Many golfers attach their golf bags to transport devices for play, such as manually powered golf carts (e.g., user propelled push or pull carts) or self propelled carts (e.g., motorized golf carts, optionally carts on which one or more golfers may ride). Typically, golf bags will be secured to these transport devices using a securing strap that extends at least partially around the golf bag to hold the bag in place with respect to the transport device. The securing straps usually contact toward the top of the bag (well above the bag's center of gravity) to help prevent the bag from spilling off the transport device (e.g., on hills, on quick starts or stops, etc.).

Conventional golf bags also often include one or more pockets or compartments in which various items and golf accessories may be carried. For instance, pockets often are provided to hold golf balls, golf tees, towels, ball markers, rain gear, and the like. Due to the size of golf bags and their necessary portable nature, the area for including pockets is somewhat limited. Because the top of the golf bag often is needed for engaging a securing strap of a transport device, as noted above, the top central area of many golf bags will not include pockets because pockets at that location would typically be crushed when the securing strap is engaged around the bag, thereby crushing and potentially damaging the contents of the bag and/or limiting access to the pocket. Thus, pockets typically are provided at lower portions of the golf bag structure and at the sides of the golf bag structure. Low pockets force the user to repeatedly bend down to gain access to the items stored in the pockets. Side mounted pockets also can be difficult to access, e.g., particularly when two golf bags are mounted in close proximity to one another on a single transport device or when sides of the transport device are in close proximity to the pockets.

Not all transport devices hold golf bags in the same orientation. Some transport devices (or transporting techniques) may cause the clubs to lean (under the force of gravity) in one direction with respect to the bag, while other transport devices (or transporting techniques) may cause the clubs to lean (under the force of gravity) in another direction (and often in the opposite direction) with respect to the bag. If the clubs with longer shafts (e.g., woods) are positioned at a "lower position" in the golf bag than clubs with shorter shafts (e.g., irons) when the bag is being used, the heads of the shorter clubs can bang into the shafts of the longer clubs and damage the shafts (e.g., including structural damage that may weaken the shafts and/or aesthetic damage, such as scratches, dings, etc.).

Many golf bags have club dividers or separators with locations or compartments specifically tailored for holding certain clubs, such as the driver, the putter, etc. In such bags, if the compartment for the driver is located on the "low side" of the bag with respect to a specific transport device or technique, this risks damage to the driver shaft due to the heads of the irons banging into the driver shaft. In an effort to address this problem, bags may come in two styles, e.g., one style with special compartments (e.g., for the driver or putter) located at a first side of the bag (for transport devices or techniques in which the clubs lean one direction) and another style with these same special compartments (e.g., for the driver or putter) located at the opposite side of the bag (for transport devices or techniques in which the clubs lean in the opposite direction). These "fixes" increase manufacturing costs and complexities because the club divider fits into the bag body in only one orientation, which requires more manufacturing controls (to assure proper orientation of the parts during assembly) and/or greater bag part inventories (to enable the manufacturer to make bags of both styles). Also, the manufacturer may need to target specific bag styles to specific locations or markets (e.g., to locations or markets having one type of transport devices or techniques or the other).

Accordingly, there is room for improvement in the golf bag art, at least in the various areas noted above.

BRIEF SUMMARY OF THE INVENTION

The following presents a simplified summary of the present invention in order to provide a basic understanding of some aspects of the invention. This summary is not an extensive overview of the invention. It is not intended to identify key or critical elements of the invention, nor is it intended to delineate the scope of the invention. The following summary merely presents some features and aspects of the invention in a simplified form as a prelude to the more detailed description that follows.

Aspects of this invention relate to golf bags for carrying and/or storing multiple golf clubs (e.g., on a golf course, during travel, etc.). Golf bags according to at least some examples of this invention may include a container defining a main compartment for holding a plurality of golf clubs, the container including a top portion having an open first end for receiving golf club shafts to be held, and a flip pocket including a first part permanently engaged with or integrally formed as part of the container (e.g., located proximate to the top portion of the container) and a second part not permanently engaged with or integrally formed as part of the container, wherein the second part of the flip pocket is movable between a closed or engaged position and an open or disengaged position. Golf bags according to at least some examples of this invention further may include one or more of: (a) a releasable connector system for releasably holding the flip pocket in the closed or engaged position; (b) an anti-slip element engaged with or integrally formed as part of the golf bag body member and optionally located at least partially behind the flip pocket when the flip pocket is in its closed or engaged position; and/or (c) a divider provided at the top portion of the container, e.g., to help keep the golf clubs separated from one another when stored in the main compartment of the golf bag.

Optionally, at least the outer perimeter of the divider may be: (a) symmetric about a first axis extending in a front-to-rear direction, (b) symmetric about a second axis extending in a side-to-side direction, and/or (c) symmetric about a third axis extending in a top-to-bottom direction (when the golf bag is oriented in an upright manner, e.g., as shown in the figures).

One or more separator panels within the perimeter of the divider also may be positioned so as to define plural club receiving spaces within the perimeter, and, if desired, the club receiving spaces may be arranged so as to be symmetric with respect to one or more of the axes noted above.

Additional aspects of this invention relate to methods of making golf bags, e.g., of the various types described above, as well as to methods of using such golf bags (e.g., securing them to a transport device).

BRIEF DESCRIPTION OF THE DRAWINGS

A more complete understanding of the present invention and at least some advantages thereof may be acquired by referring to the following description in consideration of the accompanying drawings, in which like reference numbers indicate like features, and wherein.

DETAILED DESCRIPTION OF THE INVENTION

Figure 1A:
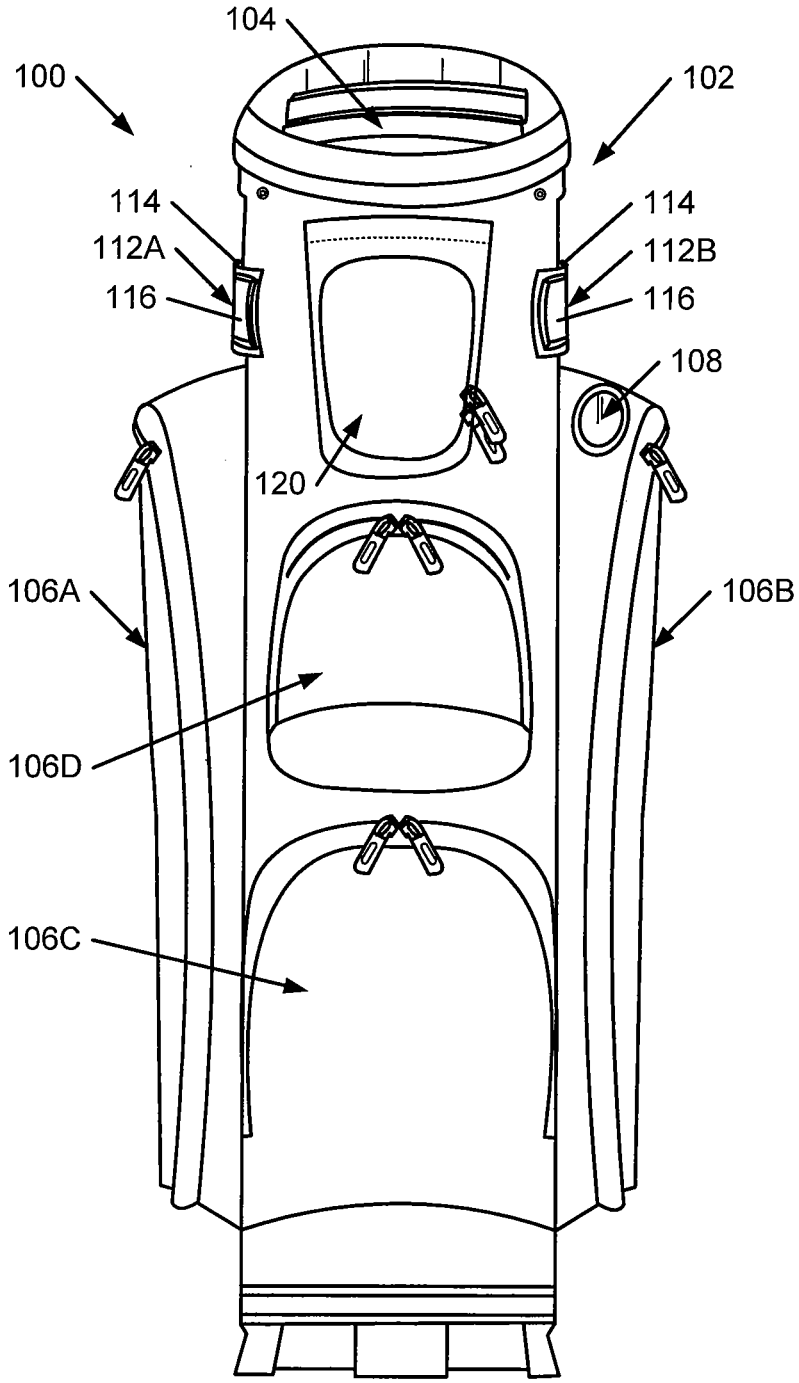
FIGS. 1A and 1B illustrate a golf bag structure according to one example of this invention.

In the following description of various examples of the present invention, reference is made to the accompanying drawings, which form a part hereof, and in which are shown by way of illustration various example structures and environments in which aspects of the invention may be practiced. It is to be understood that other structures and environments may be utilized and structural and functional modifications may be made from the specifically described structures without departing from the scope of the present invention.

I. General Description of Aspects of This Invention

Aspects of this invention relate to golf bags for carrying and/or storing multiple golf clubs (e.g., on a golf course, during travel, etc.). More specifically, golf bags in accordance with at least some examples of this invention may include: (a) a golf bag body member defining a main compartment for holding a plurality of golf clubs, the golf bag body member including an open first end for receiving golf club shafts to be held; (b) a flip pocket; and (c) an engagement system for engaging the flip pocket with the golf bag body member. This engagement system may permanently engage a first portion of the flip pocket with the golf bag body member, wherein a second portion of the flip pocket is movable with respect to the golf bag body member. Furthermore, this engagement system allows the second portion of the flip pocket to be movable with respect to the first portion of the flip pocket between: (a) a closed position in which a portion of a surface area of the golf bag body member is in a covered condition and (b) an open position in which that same portion of the surface area of the golf bag body member is in an exposed condition.

Golf bags according to other examples of this invention may include: (a) a golf bag body member defining a main compartment for holding a plurality of golf clubs, the golf bag body member including an open first end for receiving golf club shafts to be held; (b) a pocket having a first portion permanently engaged with or integrally formed as part of the golf bag body member, wherein the pocket includes a first part of a releasable connection structure at a location spaced from the first portion of the pocket; and (c) a second part of the releasable connection structure engaged with or integrally formed as a part of the golf bag body member, wherein the second part of the releasable connection structure is provided at a location of the golf bag body member so as to be capable of interacting with the first part of the releasable connection structure provided with the pocket to releasably engage a second portion of the pocket with the golf bag body member.

Additional aspects of this invention relate to golf bags that include, for example: (a) a container defining a main compartment for holding a plurality of golf clubs, the container including a top portion having an open first end for receiving golf club shafts to be held; (b) a flip pocket including a first (e.g., top) part permanently engaged with or integrally formed as part of the container (optionally proximate to the top portion of the container) and a second (e.g., bottom) part not permanently engaged with and not integrally formed as part of the container, wherein the flip pocket is movable between an engaged position and a disengaged position; and (c) a releasable connector system for releasably holding the flip pocket at the engaged position, wherein the releasable connector system includes: (a) a first component engaged with or integrally formed as part of the flip pocket closer to the second part of the flip pocket than to the first part of the flip pocket and (b) a second component engaged with or integrally formed as part of the container at a location so as to be able to interact with the first component when the flip pocket is at the engaged position.

In some additional aspects of this invention, the golf bags optionally may include a first anti-slip element engaged with or integrally formed as part of the golf bag body member. This first anti-slip element may be located behind the flip pocket such that the flip pocket at least partially covers (and in some examples, fully covers) the first anti-slip element when the flip pocket is at its engaged or closed position. The rear surface of the flip pocket and a major surface of the first anti-slip element may be positioned to contact opposite sides of a strap for securing the golf bag body member to a transport device when the pocket is at the engaged or closed position. The first-anti-slip element helps hold the strap in place with respect to the golf bag so that the golf bag will be less susceptible to spinning or twisting as it is being transported by the transport device (e.g., a hand-pulled or hand-pushed cart, a power cart, etc.). The term "anti-slip element" as used herein, means any structure or other feature for increasing the coefficient of friction of a targeted area of the golf bag (as compared with other areas of the golf bag structure) with respect to a securing strap structure, to thereby provide a designated location for engaging a securing strap, e.g., a strap for securing the golf bag to a transport device. "Anti-slip elements" may include separate structural components (e.g., engaged with the golf bag body member), surface treatments to a targeted portion of the golf bag body member surface (e.g., tacky coatings or sprays), or the like. In some examples, the anti-slip element will be a rubber or polyurethane material, e.g., having a relatively soft surface. In other examples, the anti-slip element(s) may physically hold the strap, e.g., like a hook-and-loop fastener.

If desired, additional anti-slip elements may be provided, e.g., around the sides of the golf bag body member or other container. Optionally, these additional anti-slip elements may remain exposed or partially exposed whether the flip pocket is at the engaged and disengaged positions.

The permanent connection between the flip pocket and the golf bag body member or other container may be accomplished in any desired manner without departing from this invention, including permanent engagement structures or by integrally forming the pocket with a material of the golf bag body member or container. As some more specific examples, the top part of the flip pocket may be sewn onto the golf bag body member or container; it may be engaged with the golf bag body member or container by cements, adhesives, rivets, or the like; etc. "Permanent" engagement, as that term is used herein, means engaged in a manner not intended to separate during normal use and not readily disengaged by a user without destroying the connection.

As noted above, a portion of the flip pocket may be releasably engaged with the golf bag body member or other container so that the flip pocket may be moved with respect to the golf bag body member but still remains connected thereto. Such releasable engagements may include, for example, two or more magnets that engage one another, one (or more) magnets that engage a metal material that is attracted to the magnet, a hook-and-loop fastener system, a snap connector, other mechanical clasp connectors (e.g., of the types conventionally found on golf bags, infant seats, etc.), and the like.

Still additional aspects of this invention, relate to features of a divider provided at the top portion of the golf bag body member, e.g., to help keep the golf clubs separated from one another when stored in the main compartment of the golf bag. Such dividers may be separate components engaged with a golf bag body member or may be integrally formed (at least in part) with the golf bag body member. Optionally, the outer perimeter of the top portion of the golf bag body member and/or the outer perimeter of the divider will be symmetric about a first axis extending in a front-to-rear direction and symmetric about a second axis that is perpendicular to the first axis and extending in a side-to-side direction. Still further, if desired, the outer perimeter of the top portion of the golf bag body member and/or the outer perimeter of the divider may be symmetric about a third axis that is perpendicular to the first and second axes and extends in a top-to-bottom direction (when the golf bag is oriented in an upright manner, e.g., as shown in the figures). Any separator structures or panels provided within the perimeter of the divider or the top portion of the golf bag may define plural club receiving spaces within the perimeter, and if desired, the club receiving spaces may be arranged so as to be symmetric with respect to one or more of the axes described above. These symmetry features ease various manufacturing aspects of golf bag structures according to examples of this invention in that the divider may be attached to the golf bag in either of two orientations. These features also allow the same golf bag body member and divider parts to be used for bags directed to various different markets.

Additional aspects of this invention relate to methods of making golf bags, e.g., of the various types described above. Such methods may include, for example, one or more of the following: (a) permanently engaging a first portion of a pocket with a golf bag body member (e.g., by sewing, by cements or adhesives, by other fusing techniques, etc.); (b) engaging a first part of a releasable connection structure with the pocket; and (c) engaging a second part of the releasable connection structure with the golf bag body member. The first part of the releasable connection structure and the second part of the releasable connection structure are engaged at locations on the pocket and golf bag body member, respectively, such that the first part of the releasable connection structure is capable of engaging the second part of the releasable connection structure, and wherein the pocket is selectively convertible between an engaged or downward position or condition and a disengaged or flipped up position or condition. Even in the disengaged condition, however, the pocket remains permanently engaged with the golf bag body member at the first portion of the pocket. These features help prevent undesired loss of the pocket and/or inadvertent failure to keep the pocket with the golf bag.

Still additional aspects of this invention relate to methods of securing golf bags to a transport device, such as a golf cart (manual or powered carts). Such methods may include, for example, one or more of the following steps:

(a) placing a golf bag on a support portion of a transport device, wherein the golf bag may include any of the structures or features described above, such as: (i) a golf bag body member defining a main compartment for holding a plurality of golf clubs and (ii) a pocket having a first portion permanently engaged with or integrally formed as part of the golf bag body member. This pocket may include a first part of a releasable connection structure at a location spaced from the first portion of the pocket, and a second part of the releasable connection structure may be engaged with or integrally formed as a part of the golf bag body member. The pocket may be selectively movable between an engaged position and a flipped up position;
(b) placing the pocket in the flipped up position;
(c) extending a securing strap around at least a portion of the golf bag body member;
(d) securing the golf bag body member to the transport device using the securing strap;
(e) moving the pocket to the engaged position to partially cover the securing strap; and
(f) releasably engaging the first part of the releasable connection structure with the second part of the releasable connection structure to releasably hold the pocket at the engaged position (e.g., using any of the releasable connection systems or structures described above).

Such methods may further include placing a portion of the securing strap in contact with an anti-slip element provided on the golf bag (e.g., under the flip-up pocket, alongside the pocket, etc.). The securing strap may be sandwiched between a rear surface of the pocket and a major surface of an anti-slip element when the pocket is in its downward position or in its engaged condition.

Given this general description of features, aspects, structures, and arrangements according to the invention, a more detailed description of specific example golf bag structures in accordance with this invention follows.

II. Detailed Description of Example Golf Bag Structures According to the Invention Specific examples of golf bag structures according to the invention are described in more detail below. The reader should understand, however, that these specific examples are set forth merely to illustrate examples of the invention, and they should not be construed as limiting the invention.

Figure 1B:
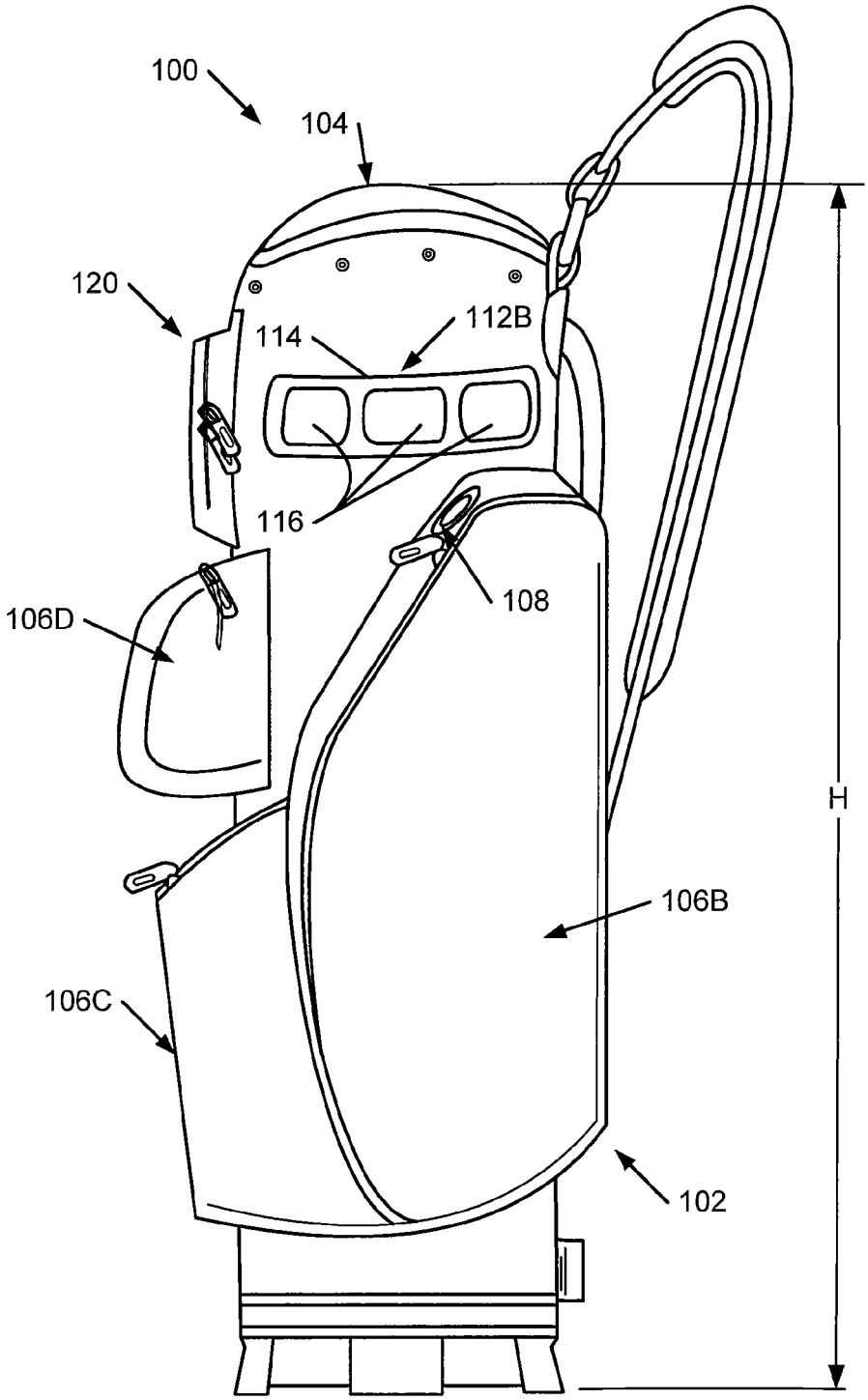

FIGS. 1A and 1B illustrate front and side views, respectively, of one example golf bag 100 in accordance with this invention. The golf bag 100 includes a golf bag body member 102 that defines an open top end 104 that provides access to a main compartment for receiving golf club shafts to be stored in the bag 100. The golf bag body member 102 may have any desired construction without departing from this invention, including conventional constructions as are known and used in the art. The golf bag body member 102 may be made from one or multiple parts and materials that are fit together in any of a variety of ways, including in conventional ways, with conventional parts and materials, as are known and used in the art.

In this illustrated example, the golf bag body member 102 includes numerous pockets 106A, 106B, 106C, and 106D positioned around the bag. Any number of pockets may be provided without departing from this invention, and these pockets may have any desired types of construction, sizes, closure systems (e.g., zippers, hook-and-loop fasteners, snaps, etc.), and the like, without departing from this invention. While not a requirement, FIGS. 1A and 1B show that pocket 106B includes an open compartment 108 that provides a designated storage spot, e.g., for storing a putter, an umbrella, a ball retriever, or the like. The structure for including such a compartment 108 (or other designated storage structure) on a golf bag also may be conventional and as is known in this art. Any number of such designated storage structures or compartments 108 may be provided on the golf bag 100 without departing from this invention.

FIGS. 1A and 1B show additional structures that may be provided in golf bags 100 in accordance with at least some examples of this invention. Even when secured by straps, when mounted on transport devices (such as motorized or user propelled golf carts), golf bags can tend to twist and turn, thereby making it difficult to access the pockets 106A through 106D and/or certain clubs within the main compartment of the bag 100. This twisting also risks dumping the bag 100 from the transport device and/or dumping the contents from the pockets 106A through 106D or the main compartment. Accordingly, golf bag structures 100 in accordance with at least some examples of this invention may include one or more anti-slip elements. Two anti-slip elements 112A and 112B are shown in FIG. 1A, each located toward the top of the bag 100, well above the bag's center of gravity. The anti-slip elements 112A and 112B increase the bag surface's coefficient of friction (as compared with the main bag surface) with respect to the materials of straps used to secure the bag 100 to a transport device. While any desired type of coefficient of friction increasing material or other structures may be used as anti-slip elements without departing from this invention, in the illustrated example bag construction 100, the anti-slip elements 112A and 112B include a base member 114 on which one or more polyurethane pads or panels 116 are mounted (e.g., by cements or adhesives, by mechanical connectors, by sewn seams, etc.). The polyurethane panel 116 surfaces provide an increased coefficient of friction and help prevent a strap from sliding with respect to the bag outer surface. The base member 114 may be engaged with (or integrally formed as part of) the golf bag body member 102 in any desired manner, including through the use of cements or adhesives, mechanical connectors, sewn seams, and the like. The polyurethane panels 116 also may have any desired size, shape, orientation, or formation (e.g., into designs, patterns, logos, etc.), and may be present in any desired number, without departing from this invention.

FIGS. 1A and 1B illustrate another pocket 120 located toward the top of the bag 100 (above the bag's center of gravity when oriented in an upright position), between the two illustrated anti-slip elements 112A and 112B. This pocket 120 may have any desired, size, shape, construction, closure mechanisms, and the like, without departing from this invention. For example, the pocket 120 (as well as one or more of the other pockets 116A through 116D) may be waterproof, insulated, lockable, stretchable, expandable, or the like, without departing from this invention. Additional potential features of this pocket 120 in accordance with at least some examples of this invention are discussed below in conjunction with FIGS. 2A and 2B.

Figure 2A:
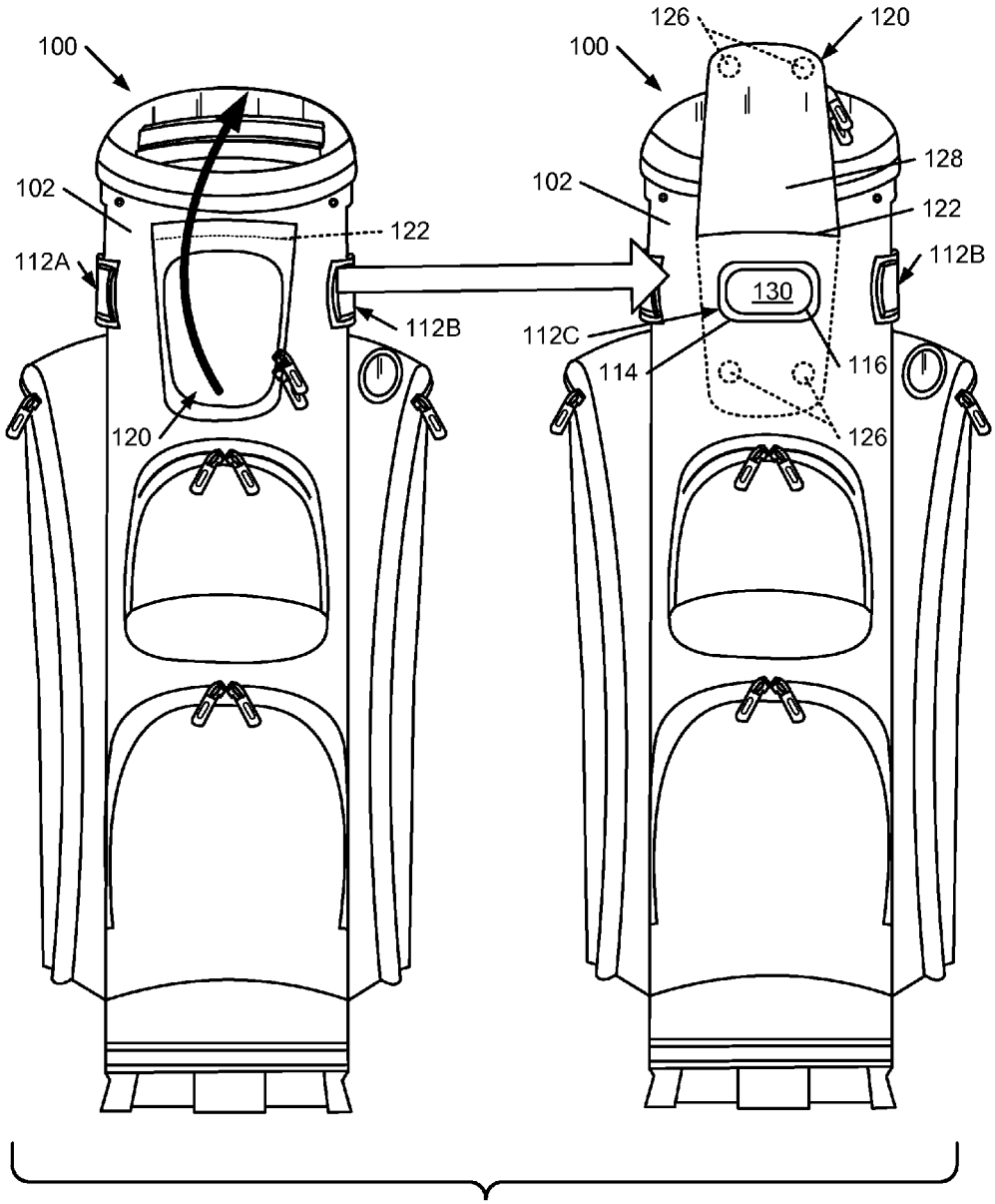
FIGS. 2A and 2B illustrate in more detail potential features of golf bag structures according to at least some examples of this invention.
Figure 2B:
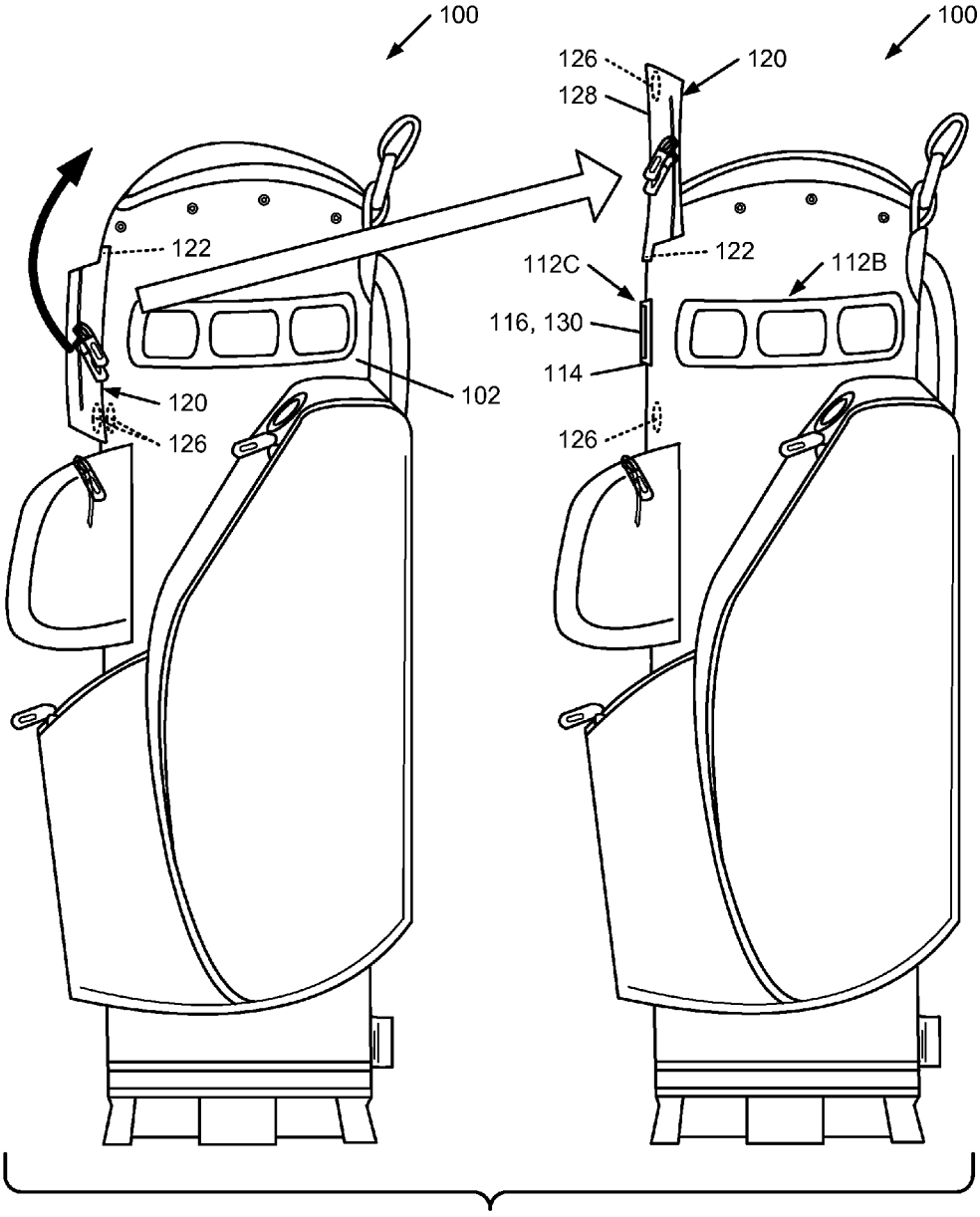

Pocket 120, as shown in FIGS. 2A and 2B, is a "flip-pocket," which means that it is capable of moving (e.g., flipping, rotating, etc.) between an engaged, flipped down, closed, or downward position (as shown at the left sides of FIGS. 2A and 2B) and a disengaged, flipped-up, open, or upward position (as shown at the right sides of FIGS. 2A and 2B). The terms "engaged position," "flipped-down position," "closed position," and/or "downward position," as used herein, do not require that any securing systems associated with the pocket 120 (as will be described in more detail below), if any, have to be engaged, merely that the flip pocket 120 is located at a position where such engagement is possible and/or that the flip pocket 120 is located with its rear surface against the golf bag body. Similarly, the terms "disengaged position," "flipped-up position," "open position," and/or "upward position," as used herein, do not require that the flip pocket 120 be located at its maximum rotated or upward position. Rather, these terms merely mean that the flip pocket 120 is moved to a position where it is not engaged by the securing system (if any) and where such engagement is not possible and/or that the flip pocket 120 is located with at least some portion of its rear surface away from the golf bag body. As shown in these figures, a rear surface 128 of the flip pocket 120 is not permanently engaged with the golf bag body member 102 around its entire periphery. The flip pocket 120 in accordance with this example of the invention provides additional storage capacity at the top, central portion of a golf bag 100, at a location where pockets are not typically provided, because such pockets would tend to be crushed by a securing strap when the golf bag is secured to a transport device.

Examples of engagement of the flip pocket 120 with the golf bag body member 102 now will be described in more detail. In some example golf bag structures 100 in accordance with this invention, one end (e.g., the top edge) of the flip pocket 120 will be permanently engaged with the golf bag body member 102. This permanent engagement may take place in any desired manner without departing from this invention, including in conventional manners for providing pockets on golf bags as are known and used in the art. In this illustrated example structure 100, the flip pocket 120 is engaged with the golf bag body member 102 by one or more sewn seams 122. Also, as shown in FIGS. 2A and 2B, preferably the permanent engagement is provided at the top portion of the flip pocket 120, so that the flip pocket 120 will hang downward toward the engaged or closed position under the force of gravity. Other arrangements are possible, however, e.g., arrangements in which the flip pocket 120 will move to a disengaged or open position under the force of gravity (e.g., if the permanent engagement is provided toward the bottom of the flip pocket 120).

Other ways of permanently engaging one portion of the flip pocket 120 with the golf bag body member 102 are possible without departing from this invention. For example, if desired, the flip pocket 120 may be held to some part of the golf bag body member 102 by rivets, screws, bolts, one or more hinges, or other permanent mechanical connectors. Cements or adhesives also may be used to permanently connect one portion of the flip pocket 120 with the golf bag body member 102. As yet another example, if desired, a portion of the flip pocket 120 may be integrally formed with a portion of the golf bag body member 102 as a unitary, one piece construction.

While not preferred, in some example structures according to some aspects of this invention, the permanent connection may be replaced with a releasable connection, if desired. In such structures, the flip pocket 120 will be completely removable from the golf bag body member 102. While possible, if desired, such structures are not preferred because this risks loss or misplacement of the flip pocket 120, with the potentially undesired effect of arriving at the golf course (or back home) without the flip pocket 120 (and the inconvenience associated with such loss or misplacement of the flip pocket 120). If desired, when such releasable flip pockets 120 are provided, some portion of the connection of the flip pocket 120 may be more difficult to disengage from the golf bag body member 102 to at least discourage complete disengagement of the flip pocket 120 (and thereby prevent or reduce undesired loss or misplacement of the flip pocket 120). As some more specific examples, the releasable connection at the top of such flip pockets may be engaged by one or more zippers, one or more mechanical clasps, etc. Even when completely removable, "flip pockets" in accordance with this aspect of the invention will be movable between engaged and disengaged positions, e.g., in the manners described in more detail below. If desired, completely removable pockets of the types described above may include a clasp, clip, or clamp to enable the pocket to be engaged with another part of the bag or some other device (such as the player's belt or belt loop).

FIGS. 2A and 2B illustrate additional potential features that may be included in golf bag structures 100 in accordance with at least some examples of this invention. For example, FIGS. 2A and 2B illustrate that the golf bag body member 102 and the flip pocket 120 may be equipped with one or more securing mechanisms that help maintain the flip pocket 120 at the engaged position (e.g., help maintain the flip pocket 120 in an engaged condition). In the example structure 100 shown in FIGS. 2A and 2B, both the golf bag body member 102 and the flip pocket 120 are equipped with one or more magnets 126. While shown as hidden in FIGS. 2A and 2B (e.g., provided beneath a layer of fabric), if desired, one or more of the magnets 126 could be exposed or mounted on an exterior surface of the golf bag body member 102 and/or the flip pocket 120 without departing from this invention. The magnets 126 in this illustrated example are located in the lower portion of the flip pocket 120 when the flip pocket 120 is oriented in the downward position. The magnets 126 releasably secure the lower portion of the flip pocket 120 to the golf bag body member 102 and help prevent undesired flipping or movement of the flip pocket 120, e.g., when the golf bag 100 is being transported on a cart.

As will become more apparent from the discussion of FIGS. 3A through 3C below, the surface of the golf bag body member and the rear side 128 of the flip pocket 120 define a channel or slot through which a transport device securing strap may pass. If desired, as shown in FIGS. 2A and 2B, at least a portion of this channel may be provided with an anti-slip surface 130, e.g., of the various types described above in conjunction with anti-slip elements 112A and 112B. The anti-slip surface 130 may be provided as part of an anti-slip element 112C, e.g., of the same general structure as those shown for anti-slip elements 112A and 112B, with a base member 114 and an anti-slip material 116 providing at least a portion of the exposed exterior surface 130 of the anti-slip element 112C. In at least some examples of this invention, the anti-slip element 112C and the strap receiving channel will be located between the permanent connection of the flip pocket 120 (e.g., seam 122) and the releasable securing system (e.g., magnets 126). Any number of anti-slip surfaces 130 and/or anti-slip elements 112C may be provided at least partially behind the flip pocket 120 (in any desired sizes, shapes, orientations, and configurations) without departing from this invention. While FIGS. 2A and 2B show this anti-slip element 112C completely covered by the flip pocket 120 when the flip pocket 120 is at the engaged position, this is not a requirement. Rather, if desired, some portion of the anti-slip element 112C may extend beyond the perimeter edges of the flip pocket 120 (and thus will be exposed even when the flip pocket 120 is in the downward position). As another alternative, if desired, anti-slip elements 112A and/or 112B may extend to the area beneath the flip pocket 120 and/or form a single, elongated anti-slip element that extends beneath the flip pocket 120.

Figure 3A:
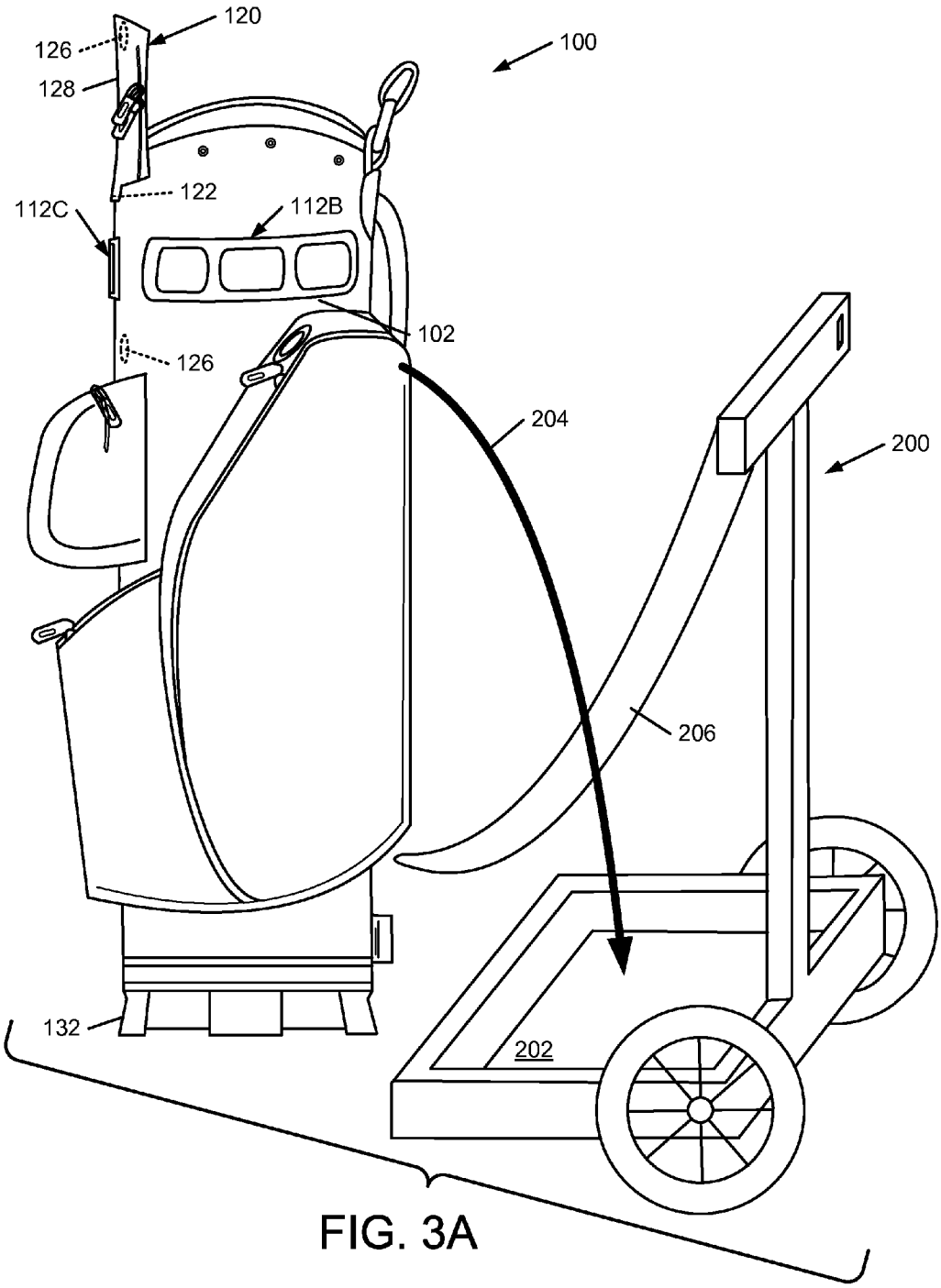
FIGS. 3A through 3C illustrate various features of attachment of golf bags according to examples of this invention to a support structure, such as a transport device, e.g., a push cart or self-propelled golf cart.
Figure 3B:
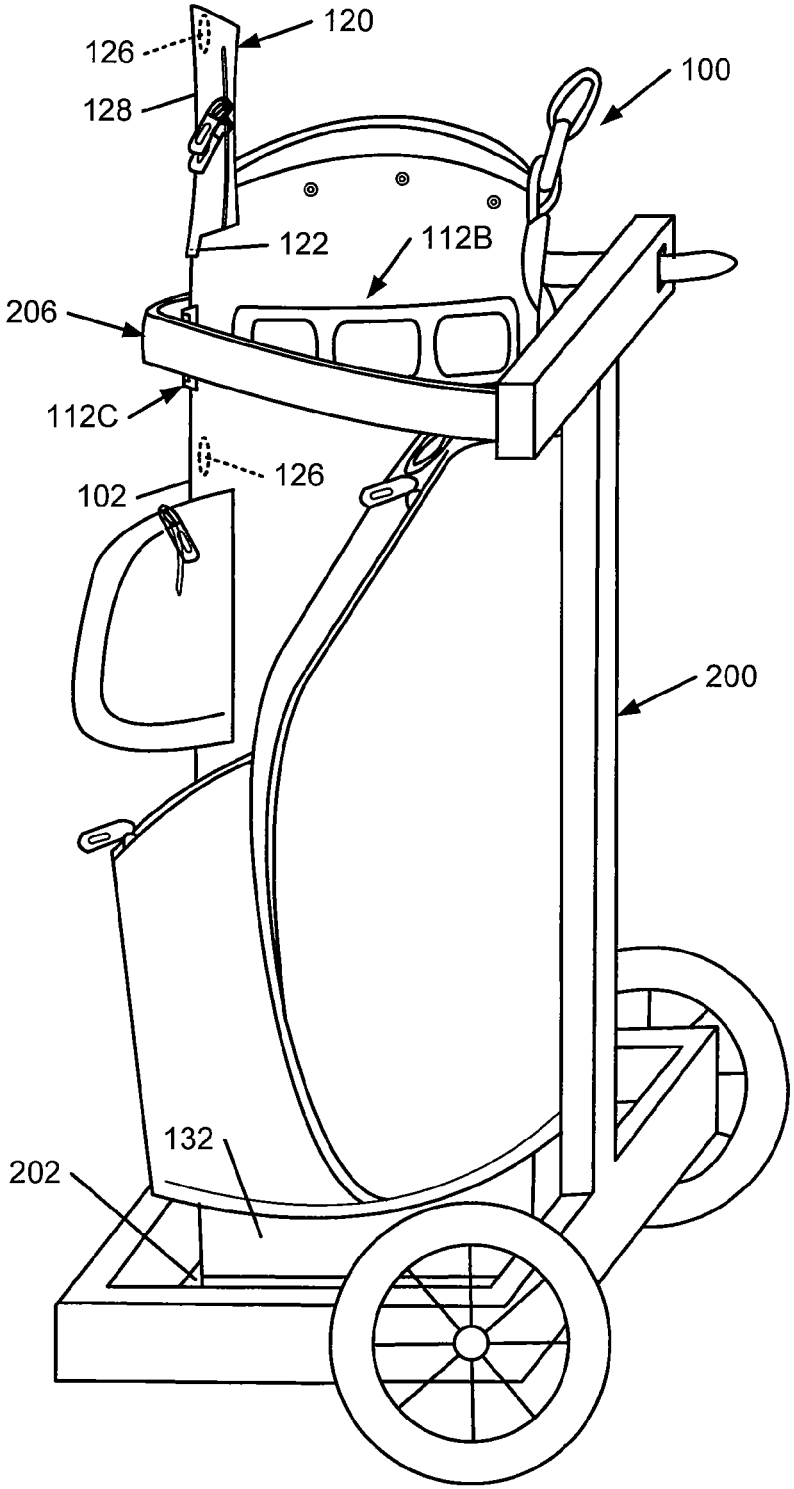
Figure 3C:
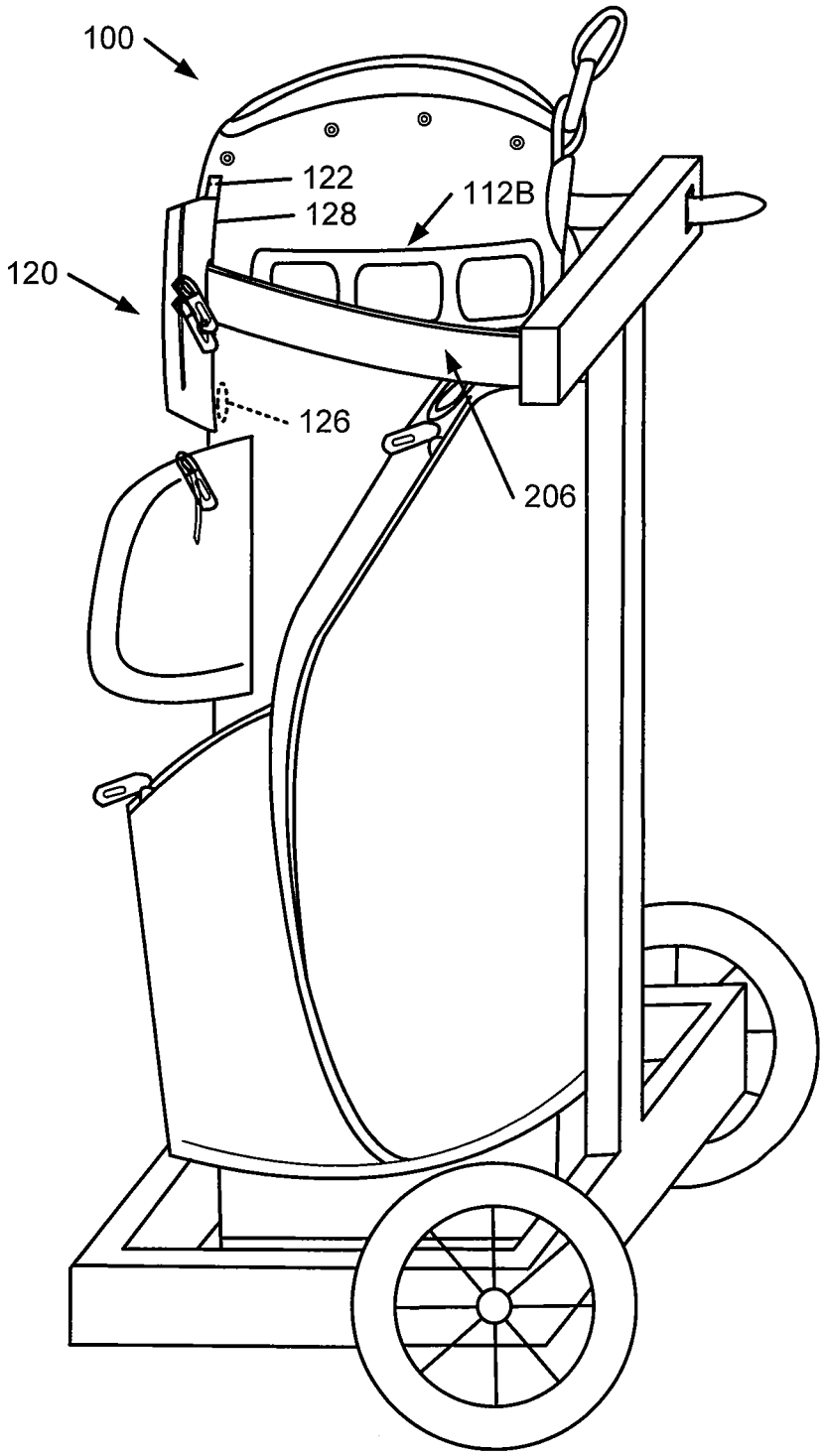

FIGS. 3A through 3C illustrate the use of golf bag structures 100 in accordance with this aspect of the invention. To secure a golf bag 100 in accordance with this invention to a transport device 200 (e.g., a hand propelled or self-propelled golf cart), the golf bag 100 is placed on a support member 202 of the transport device 200 as shown by arrow 204 in FIG. 3A and as illustrated in FIG. 3B.

In addition to a support member 202 for holding the golf bag base 132, transport devices generally will include a securing strap 206 for engaging the upper portion of the golf bag 100, to help prevent the golf bag 100 from falling off the transport device 200 during use. In accordance with at least some examples of this invention, this upper securing strap 206 is secured as follows. At some point during the bag mounting process (before or after the bag 100 is placed on support 202), the flip pocket 120 of this example golf bag structure 100 is flipped from the engaged position (and the engaged condition) to a disengaged position and condition (e.g., as shown in FIGS. 2A and 2B and described above), e.g., by overcoming the attractive force between the pairs of magnets 126 and separating the magnets 126. This disengagement opens up a space between the rear surface 128 of the flip pocket 120 and the golf bag body member 102, and in this example, exposes the anti-slip element 112C. With the space opened, the securing strap 206 can be wrapped easily around the top area of the bag 100, engaging one or more of the anti-slip elements 112A, 112B, and/or 112C (when present), and then secured on the opposite side (e.g., as generally shown in FIG. 3B). Any type of strap securing devices can be used without departing from this invention, including buckles, clamp like devices, and/or hook-and-loop fastener type systems, such as those used in conventional golf carts, child car seats, or the like.

Once properly positioned and secured, the flip pocket 120 can be returned to its engaged position and condition, e.g., as shown in FIG. 3C. In addition to or as an alternative to anti-slip element 112C provided on the golf bag body member 102, an anti-slip surface (with respect to the securing strap 206 material) may be provided at one or more other appropriate locations, for example, on the rear surface 128 of the flip pocket 120. As shown in FIG. 3C, the rear surface 128 of the flip pocket 120 and the surface of the golf bag body member 102C (optionally with the anti-slip element 112C provided thereon) define a channel or slot through which the strap member 206 extends behind the flip pocket 120.

In this manner and structural arrangement, the flip pocket 120 feature of the golf bag 100 according to this aspect of the invention provides improved storage capacity, particularly at the upper area of the golf bag (which often times can be the most conveniently accessible area of the golf bag in use) while still providing adequate securing of the bag to the transport device 200 and while not adversely impacting the contents of the flip pocket 120 when the securing strap 206 is tightened.

Many variations on the various structures and operations described above are possible without departing from this invention. For example, in the structure described above in conjunction with FIGS. 2A through 3C, the lower portion of the flip pocket 120 was releasably secured to the golf bag body member 102 using pairs of interacting magnets 126 (i.e., one magnet of the pair engaged with the flip pocket 120 and the other magnet of the pair engaged with the golf bag body member 102). This is not a requirement. For example, if desired, some of the magnets 126 may be replaced by a metal material that is attracted to a magnet. The metal material may be engaged with the golf bag body member 102 and interact with a magnet engaged with the flip pocket 120, or the metal material may be engaged with the flip pocket 120 and interact with a magnet engaged with the golf bag body member 102.

Figure 4:
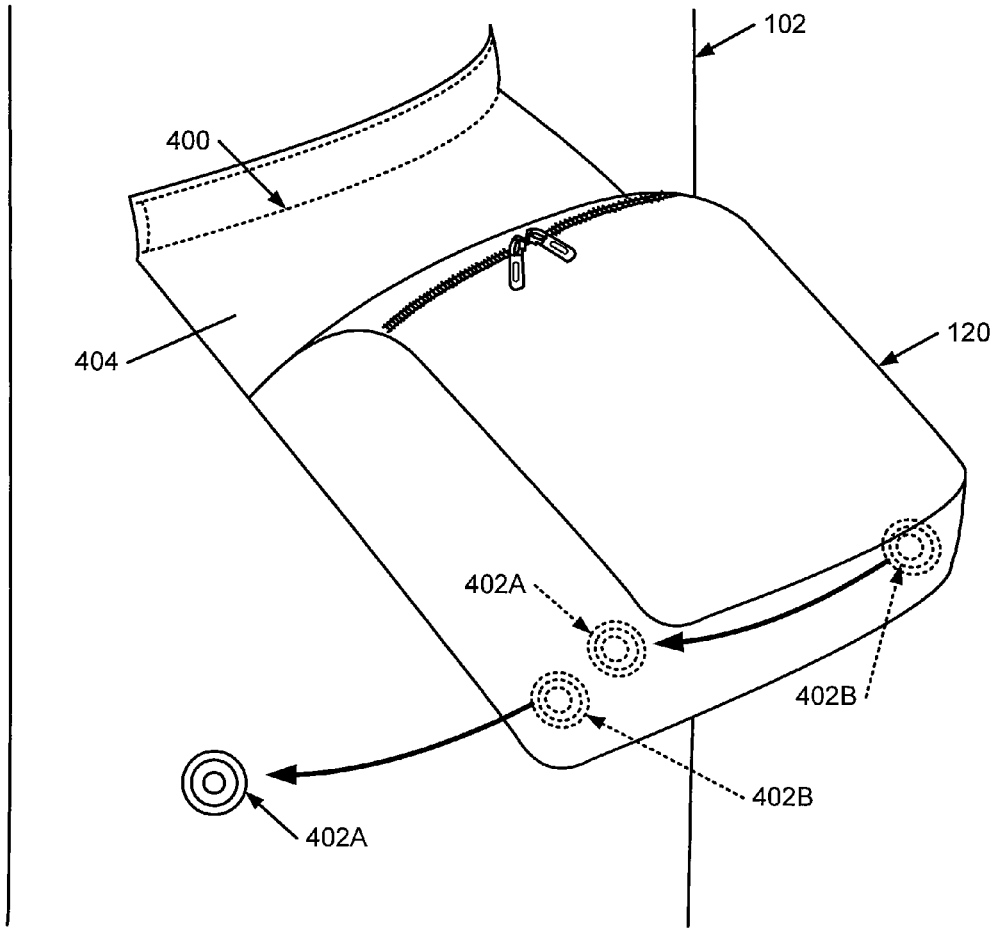
FIGS. 4 through 8 illustrate additional potential features and options for golf bag structures according to at least some examples of this invention.

Other variations in the securing mechanism are possible without departing from this invention. For example, as illustrated in FIG. 4, the top of the flip pocket 120 may be permanently engaged with the golf bag body member 102 by stitching 400, while the bottom of the flip pocket 120 is releasably engaged with the golf bag body member 102 by one or more snap mechanisms. One portion 402A of each snap mechanism may be engaged with the golf bag body member 102, while a mating portion 402B of the snap mechanism may be engaged with the flip pocket 120 (e.g., at the rear surface thereof). As also shown in FIG. 4, the material of at least the attachment portion 404 of the flip pocket 120 may be flexible enough (e.g., a textile material) that the pocket is movable about the seam 400 at which it is attached to the material of the golf bag body member 102.

Figure 5:
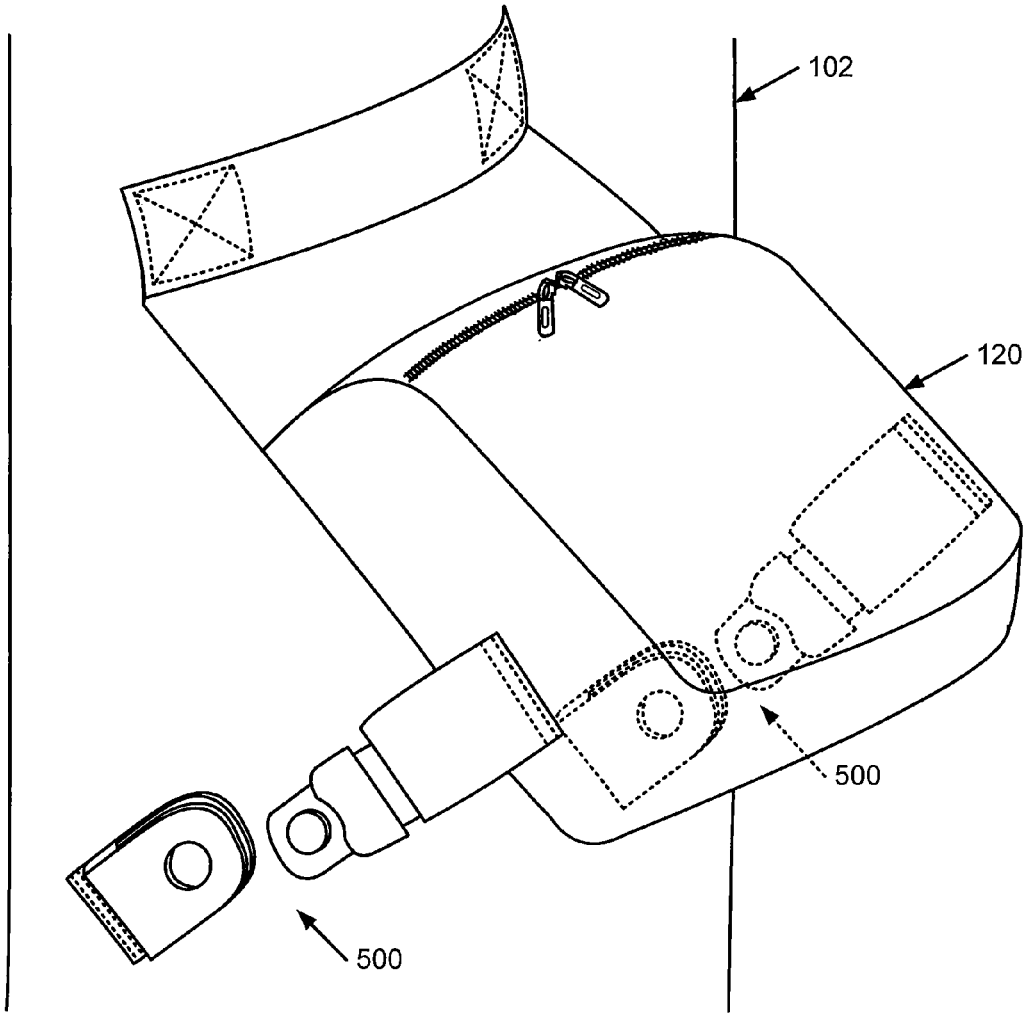

FIG. 5 shows additional and/or alternative example features that may be provided in golf bag structures in accordance with at least some examples of this invention. In this example arrangement, a mechanical clasp system 500 is provided to releasably engage the lower portion of the flip pocket 120 with the golf bag body member 102. While a mechanical clasp system of the type used with other golf bag straps is shown in FIG. 5, any desired type of releasable mechanical clasp may be provided without departing from this invention, including clasps of the types used in strollers, child car seats, high chairs, and the like. As shown in FIG. 5, in this example mechanical clasp system 500, a portion of the clasp is engaged with the golf bag body member 102 and a mating portion is provided with the flip pocket 120. While two clasp systems 500 are shown in FIG. 5, any number may be provided, in any desired locations or orientations, without departing from this invention.

Figure 6:
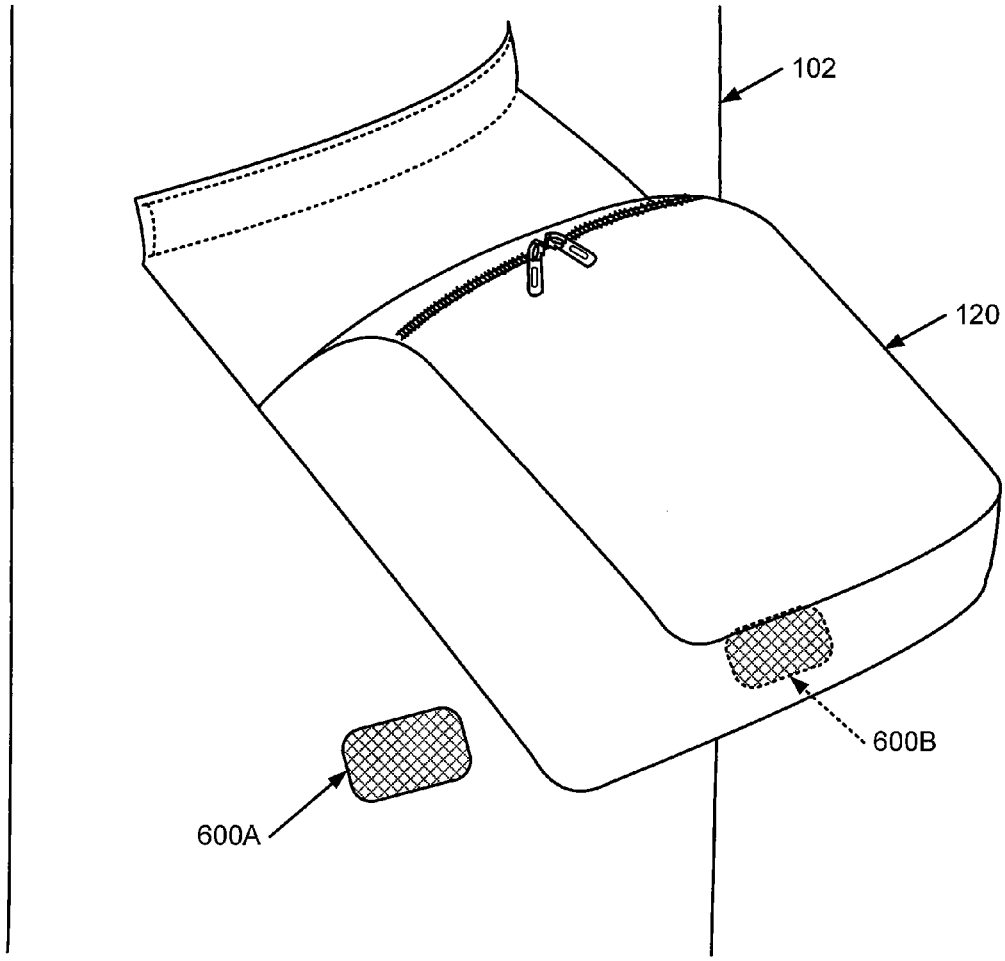

FIG. 6 shows another example flip pocket structure 120 secured by a hook-and-loop type fastener system with one portion 600A of the hook-and-loop type fastener engaged with the golf bag body member 102 and another portion 600B engaged with the rear surface of the flip pocket 120. While one hook-and-loop fastener system is shown in FIG. 6, any number may be provided, in any desired locations or orientations, without departing from this invention.

Figure 7:
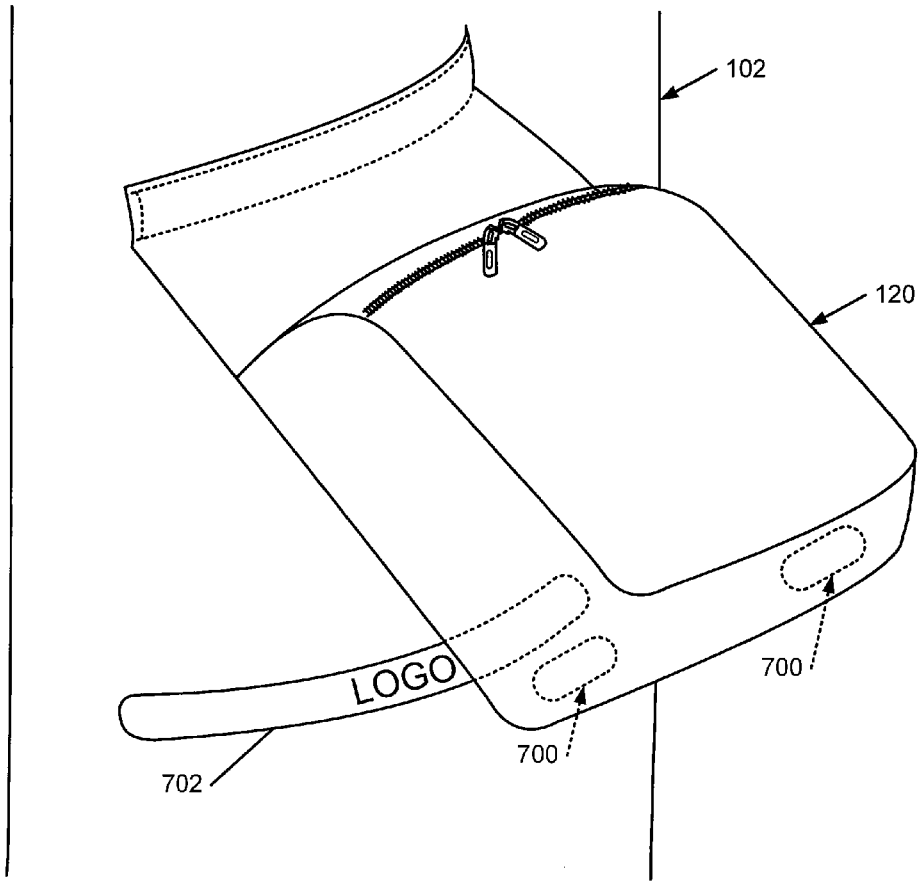
Figure 8:
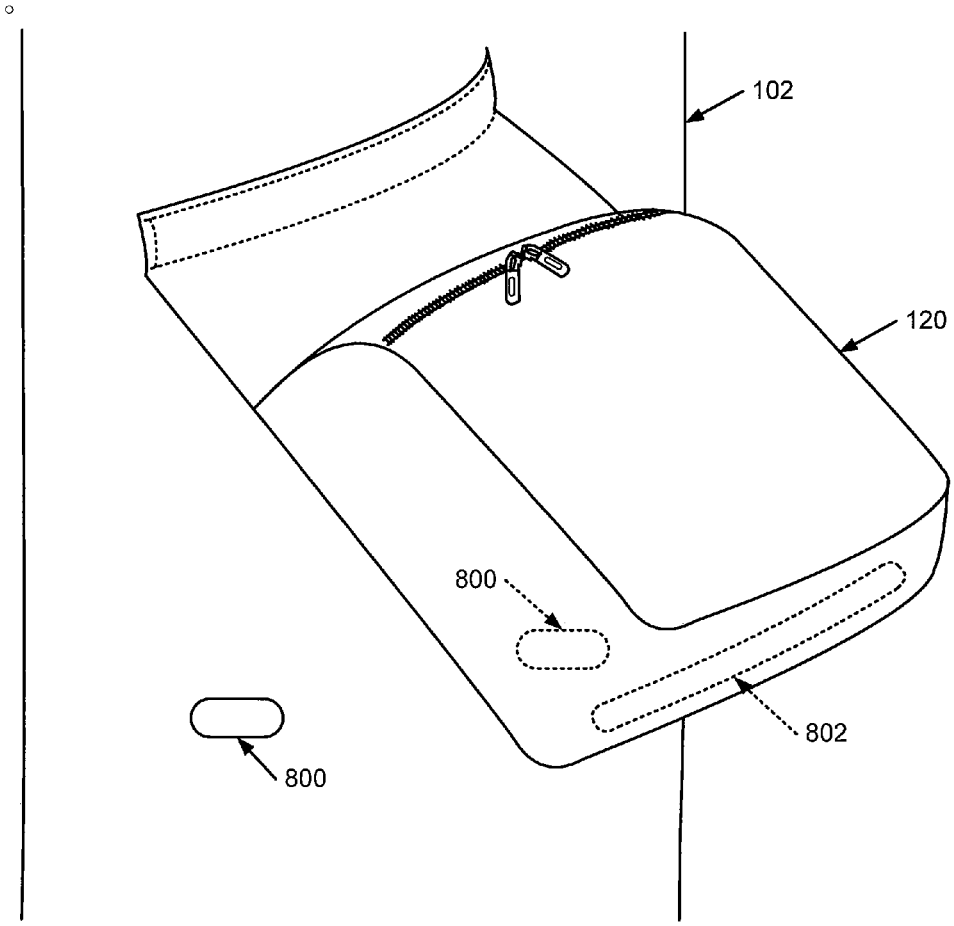

The example structures shown in FIGS. 2A through 6 all show a one-to-one match up of releasable connection elements provided on the golf bag body member 102 and the flip pocket 120. This is not a requirement. For example, as shown in FIG. 7, the flip pocket 120 may be releasably secured at the engaged position by two (or more) magnets 700 provided on the flip pocket 120 (e.g., its rear surface) that engage a single metal material member 702 provided on the golf bag body member 102. Alternatively, as shown in FIG. 8, the flip pocket 120 may be releasably secured at the engaged position by two (or more) magnets 800 provided on the golf bag body member 102 that engage a single metal material member 802 provided on the rear surface of the flip pocket 120. If desired, in any of these configurations, the metal material member may be swapped out by another magnet (such that two magnets attract one another to secure the flip pocket 120 at the engaged position). Any desired number of releasable engagement members and combinations of releasable engagement members may be used without departing from this invention.

FIGS. 1A through 8 all illustrate example flip pocket constructions and arrangements in which, when the golf bag 100 is in an upright orientation (i.e., standing on its base 132, as shown in FIGS. 1A through 3C), the top of the flip pocket 120 is permanently engaged with the golf bag body member 102 and the bottom of the flip pocket 120 is releasably engaged with the golf bag body member 102. This is not a requirement in all examples of this invention. For example, if desired, the bottom of the flip pocket 120 could be permanently engaged with the golf bag body member 102 while the top of the flip pocket 120 is releasably engaged (when the bag is in an upright orientation). As another example, if desired, one corner of the flip pocket 120 could be permanently engaged with the golf bag body member 102 (e.g., the upper left corner) while other portions thereof include releasable connections. As still another example, one side edge of the flip pocket 120 could be permanently secured at its top and bottom to golf bag body member 102 while the opposite edge or the top and/or bottom edges could be releasably secured (in this type of arrangement, the permanently secured side edge may include an unsecured central portion to define a slot through which the securing strap may be inserted for securing the golf bag to the transport device, akin to passing a strap through a belt loop).

Also, FIGS. 1A through 8 all illustrate example systems in which the permanent engagement of the flip pocket 120 is provided on one side of the location where the securing strap will pass beneath the flip pocket 120 (e.g., above the strap) and the releasable engagement is provided on the other side of the location where the securing strap will pass (e.g., below the strap). This is not a requirement for all structures in accordance with this invention. For example, if desired, the releasable securing system could be provided along the side edge of the flip pocket 120, e.g., at a location at least partially above or even with the anti-slip element (when present), such as slightly below the permanent connection area. As still another example, if desired, the releasable connectors may be completely omitted, and the flip pocket 120 can simply hang in a downward orientation under the force of gravity (optionally in contact with the golf bag surface at the closed position, when the bag is oriented in an upright position).

As yet another potential option, the structure for releasably holding the flip pocket 120 at the engaged or downward position may be provided as part of the permanent connection between the flip pocket 120 and the golf bag body member 102. One more specific example includes an arrangement in which a portion of the flip pocket 120 (e.g., its top edge, a side edge, etc.) is permanently engaged with the golf bag body member 102 by one or more hinges or other rotatable connection member(s) (e.g., the sewn seam 122 is replaced by one or more hinges). While such a flip pocket 120 still could be releasably secured at the downward or other engaged position by the connection elements as described above in conjunction with FIGS. 2A through 8, other systems for releasably holding the flip pocket 120 in place at the engaged position may be used without departing from this invention. For example, the hinge(s) mounting the flip pocket 120 to the golf bag body member 102 may include a spring or other tensioning device to bias the hinge to force the flip pocket 120 to the downward or engaged position. As another example, the hinge(s) mounting the flip pocket 120 to the golf bag body member 102 may include a lock and release mechanism (e.g., optionally like a ratchet assembly) by which the hinge(s) can be selectively transitioned between a locked condition and a movable condition. As yet another example, the hinge(s) mounting the flip pocket 120 to the golf bag body member 102 may include detents or other deformable catch mechanisms to help hold the flip pocket 120 in the downward or engaged position (e.g., akin to structures used to hold car rear view mirrors or bicycle kickstands in place).

As noted above, not all transport devices hold golf bags in the same orientation. Some transport devices (or transporting techniques) may cause the clubs to lean (under the force of gravity) in one direction with respect to the bag, while other transport devices (or transporting techniques) may cause the clubs to lean (under the force of gravity) in another direction (and often in the opposite direction) with respect to the bag. If the clubs with longer shafts (e.g., woods) are positioned at a "lower position" in the golf bag than clubs with shorter shafts (e.g., irons) when the bag is being transported, the heads of the shorter clubs may bang into the shafts of the longer clubs and damage the shafts.

Many golf bags have club dividers or separators with locations or compartments specifically tailored for holding certain clubs, such as the driver, the putter, etc. In such situations, if the compartment for the driver is located on the "low side" of the bag with respect to a specific transport device or technique selected, this orientation risks damage to the driver shaft due to the heads of the irons potentially banging into the driver shaft. In an effort to address this problem, some golf bags may come in two styles, e.g., one style with special compartments (e.g., for the driver or putter) located at a first side of the bag (for certain transport devices or techniques in which the clubs lean one direction) and another style with these same special compartments (e.g., for the driver or putter) located at the opposite side of the bag (for certain transport devices or techniques in which the clubs lean in the opposite direction). As described above, these features increase manufacturing costs and complexities for golf bags because the club divider fits into the bag in only one orientation, which requires more manufacturing controls (to assure proper orientation of the parts) and/or greater bag part inventories (to enable the manufacturer to make bags of both styles). Also, the manufacturer may need to target specific bag styles to specific locations or markets (e.g., to locations or markets having one type of transport devices or techniques or the other). If consumers buy the wrong bag for a specific transport device or technique, they risk damage to their clubs (and the manufacturer may experience significant customer dissatisfaction).

Figure 9A:
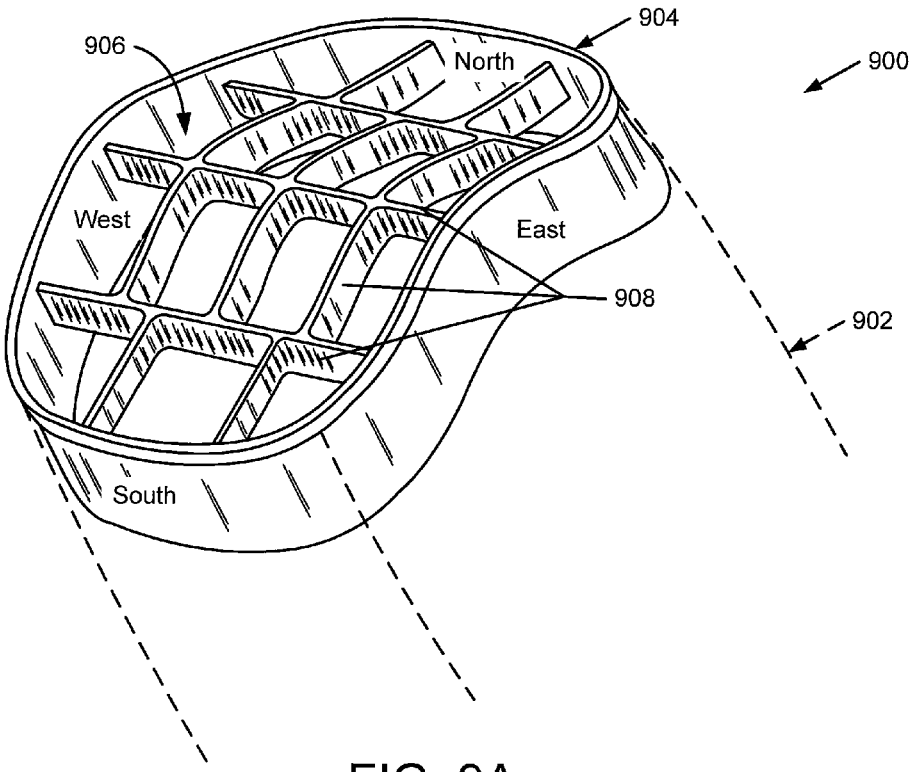
FIGS. 9A through 9C illustrate additional potential and/or alternative features of golf bag structures according to this invention.
Figure 9B:
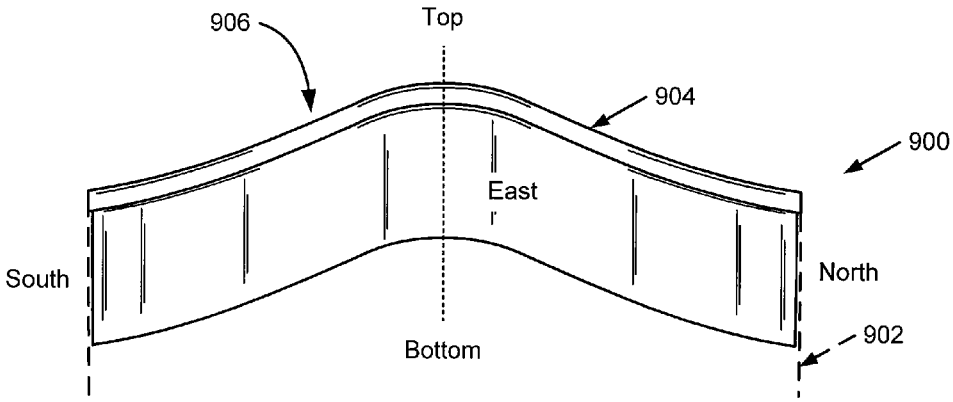
Figure 9C:
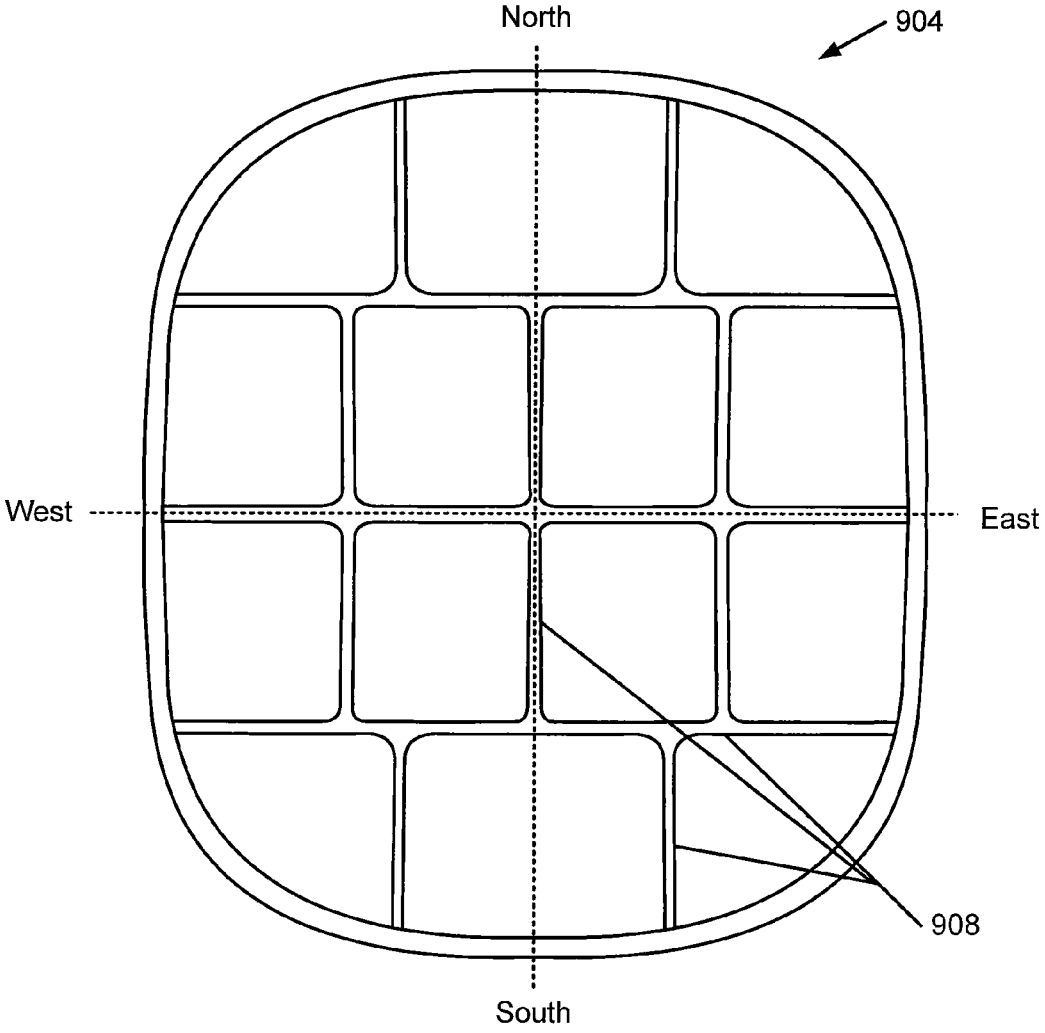

FIGS. 9A through 9C illustrate additional features of golf bags in accordance with at least some examples of this invention that seek to help eliminate or alleviate some of the problems mentioned above. As best shown in FIGS. 9A and 9B, some golf bag structures 900 in accordance with examples of this invention will include a golf bag body 902 to which a club separator or divider structure 904 is engaged. The golf bag body 902 and the club separator 904 may be engaged together in any desired manner without departing from this invention, including in conventional manners as known or used in the art, such as via cements or adhesives, by stitching or sewing, by mechanical connectors (e.g., bolts, screws, rivets, etc.), or the like. If desired, either or both of the golf bag body 902 and the club separator 904 may include structures, like tongue and groove structures or the like, that help assure that the parts are properly fit and engaged together.

The club separator 904 divides the major compartment 906 of the golf bag 900 into a plurality of different sub-compartments using one or more divider element(s) 908. While any desired number of sub-compartments may be created without departing from this invention, in this illustrated example, the main compartment 906 is subdivided into fourteen sub-compartments. Also, any number of divider elements 908 may be used to provide the overall sub-compartments for the club separator 904 without departing from this invention. The divider elements 908 may extend any desired extent of the overall bag height, e.g., including from 1% to 100% of the overall bag height H (see FIG. 1B for a representation of the height dimension H).

For convenience and ease of discussion below, the club separator 904 illustrated in FIGS. 9A through 9C is labeled with "north," "south," "east," and "west" sides or edges. As shown in FIG. 9C, the club separator 904 of this example structure is constructed such that its outer perimeter is symmetric about a center line or plane extending in the north-south direction (e.g., front-to-back on the golf bag). Additionally, as shown in FIG. 9C, the club separator 904 of this example structure is constructed such that its outer perimeter is symmetric about a center line or plane extending in the east-west direction (e.g., side-to-side on the golf bag). Additionally, if desired, the outer perimeter of the club separator 904 may be symmetric about a center line or plane running in the top-to-bottom difection, as shown in FIG. 9B. Additionally, as further shown in FIGS. 9A and 9C, the divider elements 908 may be provided such that the sub-compartments are positioned in a symmetric manner about the north-south and east-west axes.

This symmetric club separator 904 helps alleviate some of the above noted problems in various ways. First, due to its symmetric features, the sub-compartments on one side of the bag are the same as the sub-compartments on the opposite side of the bag. Therefore, the club separator 904 may be engaged with the golf bag body 902 in either of two directions (e.g., with "north" up in FIG. 9A or with "north" down in FIG. 9A). This simplifies the manufacture of the golf bag and reduces manufacturing costs (e.g., no specific golf bag 902 orientations are necessary with respect to the divider 904, no need to maintain separate inventories of golf bag bodies 902 and/or club separators 904 for different bag styles, no need to consider shipping different bag styles to different regions or different accounts, etc.).

Also, because the club separator 904 includes the same size and style sub-compartments on each of the opposing sides, the clubs can be oriented within the bag 900 in any desired manner and in manners more appropriate to the transport device or technique being used for a specific round of golf (e.g., the longer clubs can always be moved to be located toward the high end of the bag for a specific transport device and/or transport technique). These features make the bag more flexible (useful with any desired transport device or technique) and help prevent consumers from purchasing a bag that is not well suited for their specific uses (thereby helping prevent club damage and customer relationship damage).

III. Conclusion

The present disclosure and the accompanying drawings serve to provide examples of various features and concepts related to the golf bag described, not to limit the scope of the invention. One skilled in the relevant art will recognize that numerous variations and modifications may be made to the arrangements described above without departing from the scope of the present disclosure, as defined by the appended claims.

We claim:

1. A golf bag, comprising:

a container defining a main compartment for holding a plurality of golf clubs, the container including a top portion having an open first end for receiving golf club shafts to be held;

a flip pocket including a first part permanently engaged with or integrally formed as part of the container proximate to the top portion of the container and a second part not permanently engaged with and not integrally formed as part of the container, wherein the flip pocket is movable between an engaged position and a disengaged position; and a releasable connector system for releasably holding the flip pocket at the engaged position, wherein the releasable connector system includes: (a) a first component engaged with or integrally formed as part of the flip pocket closer to the second part of the flip pocket than to the first part of the flip pocket and (b) a second component engaged with or integrally formed as part of the container at a location so as to be able to interact with the first component when the flip pocket is at the engaged position.

2. A golf bag according to claim 1, wherein the first component of the releasable connector system includes a magnet or a metal material that is attracted to a magnet, and wherein the second component of the releasable connector system includes a magnet or a metal material that is attracted to a magnet, and wherein at least one of the first component or the second component constitutes a magnet.

3. A golf bag according to claim 1, wherein the releasable connector system includes at least one member selected from the group consisting of: a hook-and-loop fastener system, a snap connector, and a clasp connector.

4. A golf bag according to claim 1, further comprising:

a first anti-slip element engaged with or integrally formed as part of the container, wherein the first anti-slip element is located at a position so as to be at least partially covered by the flip pocket when the flip pocket is at the engaged position.

5. A golf bag according to claim 1, further comprising:

a first anti-slip element engaged with or integrally formed as part of the container, wherein the first anti-slip element is sized and located at a position so as to be completely covered by the flip pocket when the flip pocket is at the engaged position.

6. A golf bag according to claim 1, further comprising:

a first anti-slip element engaged with or integrally formed as part of the container, wherein the first anti-slip element is located at a position so as to be at least partially covered by the flip pocket when the flip pocket is at the engaged position;

a second anti-slip element engaged with or integrally formed as part of the container, wherein the second-anti slip element is located at a first side of the flip pocket; and a third anti-slip element engaged with or integrally formed as part of the container, wherein the third-anti slip element is located at a second side of the flip pocket opposite the first side.

7. A golf bag according to claim 6, wherein the second anti-slip element is not covered by the flip pocket when the flip pocket is at the engaged position, and wherein the third anti-slip element is not covered by the flip pocket when the flip pocket is at the engaged position.

8. A golf bag according to claim 1, wherein the first component of the releasable connector system is located on a first side of the flip pocket, and wherein the releasable connector system further includes a third component engaged with the flip pocket on a second side of the flip pocket opposite the first side and closer to the second part of the flip pocket than to the first part of the flip pocket.

9. A golf bag according to claim 8, wherein the third component of the releasable connector system is provided at a location so as to be able to interact with the second component when the flip pocket is at the engaged position.

10. A golf bag according to claim 8, wherein the releasable connector system further includes a fourth component engaged with or integrally formed as part of the container at a location so as to be able to interact with the third component when the flip pocket is at the engaged position.

11. A golf bag according to claim 1, wherein the releasable connector system includes a third component engaged with or integrally formed as part of the container, wherein the first component of the releasable connector system is sized and positioned so as to be able to interact with both the second component and the third component when the flip pocket is at the engaged position.

12. The golf bag of claim 1 wherein:

the first part of the flip pocket is a first edge of the flip pocket;

the second part of the flip pocket is a second edge of the flip pocket opposite the first edge; and at least a portion of a rear surface of the flip pocket is positioned against a portion of a surface area of the container when the flip pocket is at the engaged position.

13. The golf bag of claim 1 wherein the flip pocket is located proximate to the top portion of the container and is accessible when the flip pocket is at both the engaged position and the disengaged position.

14. The golf bag of claim 1 wherein a rear surface of the flip pocket and a portion of a surface area of the container define a channel when the flip pocket is at the engaged position through which a strap for securing the golf bag is laterally receivable.

15. A golf bag, comprising:

a golf bag body member defining a main compartment for holding a plurality of golf clubs, the golf bag body member including an open first end for receiving golf club shafts to be held;

a pocket having a top portion permanently engaged with or integrally formed as part of an upper portion of the golf bag body member and a bottom portion not permanently engaged with and not integrally formed as part of the upper portion of the golf bag body member, wherein the pocket includes: (a) a first part of a first releasable connection structure at a location spaced downward from the top portion of the pocket and (b) a first part of a second releasable connection structure at a location spaced downward from the top portion of the pocket, and wherein the pocket is movable between an engaged position and a disengaged position;

a second part of the first releasable connection structure engaged with or integrally formed as part of the golf bag body member, wherein the second part of the first releasable connection structure is provided at a location of the golf bag body member so as to be able to interact with the first part of the first releasable connection structure provided with the pocket when the pocket is at the engaged position;

a second part of the second releasable connection structure engaged with or integrally formed as part of the golf bag body member, wherein the second part of the second releasable connection structure is provided at a location of the golf bag body member so as to be able to interact with the first part of the second releasable connection structure provided with the pocket when the pocket is at the engaged position; and a first anti-slip element engaged with or integrally formed as part of the golf bag body member, wherein a rear surface of the pocket and a major surface of the first anti-slip element are positioned to provide a slot for a strap when the pocket is at the engaged position.

16. The golf bag of claim 15 wherein:

the top portion of the pocket is a first edge of the pocket;

the bottom portion of the pocket is a second edge of the pocket opposite the first edge; and a rear surface of the pocket is positioned against a portion of a surface area of the golf bag body member when the pocket is at the engaged position.

17. A golf bag according to claim 16, wherein the first releasable connection structure includes at least one magnet and the second releasable connection structure includes at least one magnet.

18. A golf bag according to claim 16, wherein the first releasable connection structure includes a hook-and-loop fastener system and the second releasable connection structure includes a hook-and-loop fastener system.

19. A golf bag according to claim 16, wherein the first releasable connection structure includes a snap connector and the second releasable connection structure includes a snap connector.

20. A golf bag according to claim 16, wherein the first releasable connection structure includes a clasp connector and the second releasable connection structure includes a clasp connector.

21. The golf bag of claim 16 wherein the pocket is located proximate to the upper portion of the golf bag body member and is accessible when the pocket is at both the engaged position and the disengaged position.

22. The golf bag of claim 16 wherein a rear surface of the pocket and a portion of a surface area of the golf bag body member define a channel when the pocket is at the engaged position through which a strap for securing the golf bag is laterally receivable.

23. A golf bag comprising:

a golf bag body member defining a main compartment for holding a plurality of golf clubs, the golf bag body member including an open first end for receiving golf club shafts to be held;

a flip pocket including a first part permanently engaged with a top portion of the golf bag body member and a second part not permanently engaged with the top portion of the golf bag body member; and an engagement system for engaging the flip pocket with the golf bag body member, wherein the engagement system permanently engages the first part of the flip pocket with the golf bag body member, and wherein the engagement system allows the second part of the flip pocket to be movable with respect to the first part of the flip pocket between: (a) a closed position in which a portion of a surface area of the golf bag body member is in a covered condition and (b) an open position in which that same portion of the surface area of the golf bag body member is in an exposed condition;

wherein the flip pocket is located proximate to the top portion of the golf bag body member and is accessible when the flip pocket is at both the closed position and the open position.

* * * * *